US012486629B1

(12) United States Patent
McCallum

(10) Patent No.: US 12,486,629 B1
(45) Date of Patent: Dec. 2, 2025

(54) METHOD AND APPARATUS FOR REJUVENATING LINES ON ROADS

(71) Applicant: Erick McCallum, Fort Worth, TX (US)

(72) Inventor: Erick McCallum, Fort Worth, TX (US)

( * ) Notice: Subject to any disclaimer, the term of this patent is extended or adjusted under 35 U.S.C. 154(b) by 51 days.

(21) Appl. No.: 18/421,483

(22) Filed: Jan. 24, 2024

(51) Int. Cl.
*E01H 1/10* (2006.01)

(52) U.S. Cl.
CPC ..... *E01H 1/103* (2013.01)

(58) Field of Classification Search
CPC ..... E01H 1/103
USPC ..... 134/172
See application file for complete search history.

(56) References Cited

U.S. PATENT DOCUMENTS

| | | | |
|---|---|---|---|
| 4,351,723 | A | 9/1982 | Palmer |
| 4,782,974 | A | 11/1988 | Elkayam |
| 5,500,976 | A | 3/1996 | Rohrbacher et al. |
| 5,711,051 | A | 1/1998 | Roden |
| 6,896,742 | B2 | 5/2005 | Geyer et al. |
| 7,735,186 | B1 | 6/2010 | Vogel |
| 8,677,555 | B1 | 3/2014 | McCallum |
| 9,890,508 | B2 | 2/2018 | McCullum |
| 10,858,792 | B2 | 12/2020 | McCallum |
| 2005/0217708 | A1 | 10/2005 | Otterson |
| 2005/0268425 | A1 | 12/2005 | Clemons, Sr. |
| 2007/0169305 | A1 | 7/2007 | Shea |
| 2008/0141483 | A1 | 6/2008 | Pearlstein |
| 2010/0170536 | A1 | 7/2010 | Heinonen et al. |
| 2019/0376245 | A1 | 12/2019 | McCallum |

FOREIGN PATENT DOCUMENTS

| | | | |
|---|---|---|---|
| CN | 209798631 | U | 12/2019 |
| CN | 116145528 | A | 5/2023 |
| EP | 2210982 | A2 | 7/2010 |
| FR | 2918085 | A1 | 1/2009 |
| WO | 2015147805 | A1 | 10/2015 |
| WO | 2019237110 | A1 | 12/2019 |

OTHER PUBLICATIONS

CN209798631U—machine translation (Year: 2019).*
International Search Report dated Mar. 26, 2025 from International Application No. PCT/US2025/012651.
Written Opinion of the International Searching Authority dated Mar. 26, 2025 from International Application No. PCT/US2025/012651.

* cited by examiner

*Primary Examiner* — Tinsae B Ayalew
(74) *Attorney, Agent, or Firm* — James E. Walton

(57) ABSTRACT

An apparatus for rejuvenating markings on roads includes at least one cleaning unit, a collection tank, a vacuum member, and a connection point. At least one cleaning unit includes a frame, at least one skirt member, at least one spray connection, and a wand member. The skirt member is coupled to an external surface of the frame. The spray connection is disposed at least partially on a top surface of the frame, and the wand member is coupled to the underside of the spray connection. The collection tank includes a plurality of entry points and at least one vacuum connection. Each entry point is configured to mate with a hose. The vacuum member works with the collection tank such that material is vacuumed from underneath the cleaning unit into the collection tank and then into a storage tank. The connection point is configured for attachment to a maneuvering member.

17 Claims, 14 Drawing Sheets

METHOD AND APPARATUS FOR REJUVENATING LINES ON ROADS

BACKGROUND

1. Field of the Invention

The present invention relates generally to environmentally friendly cleaning and rejuvenating processes, and more specifically to a system and method for cleaning and rejuvenating markings on pavement or other hard surfaces.

2. Description of Related Art

When a spill occurs on a roadway, sidewalk, industrial site, or other hard surface, a cleanup system and method is required. Such spills may include any organic or other material, such as oil, fuel, and other similar substances. Generally, the cleanup process following these spills is complicated, time consuming, ineffective, or some combination of the three. Typically, an absorbent material is spread over the affected area, then swept away and collected, the process being repeated until all excess material is absorbed.

In addition to material spills, general wear and tear can result in the buildup of dirt, debris, oxidized paint, and other sediment that may interfere with standard use of the surface. For example, marking systems such as lane striping on roads can become dirty, dull, and non-reflective resulting in lines that are more difficult for drivers and autonomous vehicles to see. When such markings become dull, they are often repainted or remarked, which can be a slow and/or expensive process and difficult to perfectly match the previous markings.

A need, exists, therefore, for improvements in systems and methods for cleaning markings on pavement or other hard surfaces. Although great strides have been made in cleaning systems, considerable shortcomings remain.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1A:
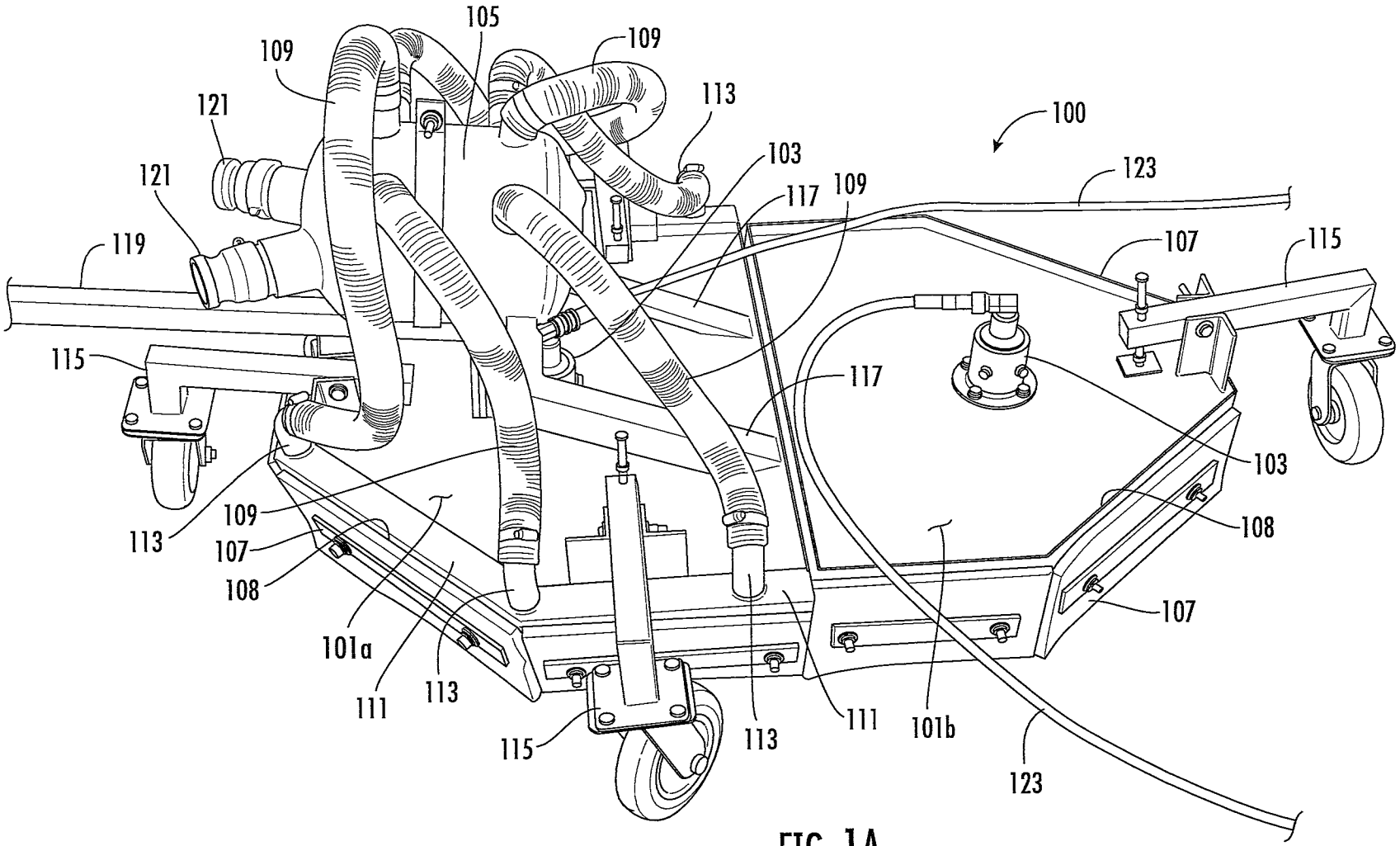
FIG. 1A is a side perspective view of an apparatus for rejuvenating lines on roads according to a preferred embodiment of the present application.

While the assembly and method of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of a method and apparatus for rejuvenating lines on roads according to the present application are provided below. It will of course be appreciated that in the development of any actual embodiment, numerous implementation-specific decisions will be made to achieve the developer's specific goals, such as compliance with assembly-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The present application is directed to a method and apparatus for rejuvenating lines and markings on roads. Although largely presented with respect to lines and markers on a roadway, it should be understood and appreciated that alternative embodiments may be configured for cleaning additional surface types, not being limited to line markers on roadways.

In operation, the apparatus of the present application is uniquely configured for recirculating a substantial portion of the water used. Optionally pressured and heated water is carried by a vehicle with water storage capabilities until line rejuvenation is set to being. The water is then directed from the vehicle's storage systems through a series of hoses to the apparatus described in detail below. Although water is a preferred substance for cleaning and rejuvenating the surface, it should be appreciated that alternative substances may be used, such as a pre-treat substance used to break down oil or other pollutants often found on roadways; for the most efficient operation of the present system, any substance or chemical used should be low foam. Following propulsion of the water onto the surface, the apparatus moves over the area using a squeegee-like effect while vacuuming liquid and other material from the surface while in their emulsified state. The rear-most portion of the system is the most important for squeegee purposes, such that there is little to no substance left on the road after the apparatus passes.

The vacuum system operates to remove the liquids and other material, such as dirt and debris, from the area being cleaned. The vacuum system works to remove the substances from the apparatus into the vehicle storage tank, such that the water can then be recycled and reused to spray back onto the road as the system moves along. A series of filters and/or screens may be utilized within the vehicle to remove any silt, dirt, or small rocks that may have been picked up in operation.

Under the preferred embodiment, the unique water recycling capabilities of the system provide for recycling and reuse of approximately 98% of the water used during operation. It should be understood that some water loss is likely to occur when the system moves over bumps, such as potholes or road reflectors, thus causing the system to temporarily lose adequate squeegee effect. The unique configuration allows for both an increase in water utilization efficiency and a decrease in environmental impact. In additional embodiments, the system may be raised to a higher level off the surface, which may result in the need for more water and higher amounts of water loss.

The unique method of rejuvenating lines on roads is designed to remove substantial amounts of dirt, debris, hydrocarbon settlement, oxidized paint, and various other substances in an efficient manner; the removal of such materials results in a rejuvenated surface, which helps to avoid the need for more costly and time-consuming projects like removing and repainting lines. Under the preferred embodiment, the apparatus is configured to clean and rejuvenate a surface at a pace of approximately four to seven miles per hour. Such pace results in a goal of covering approximately thirty linear miles in a single night, with minimal traffic impact being a goal. It should be understood that exact pace may vary depending on how many units are utilized within a selected system.

Figure 1B:
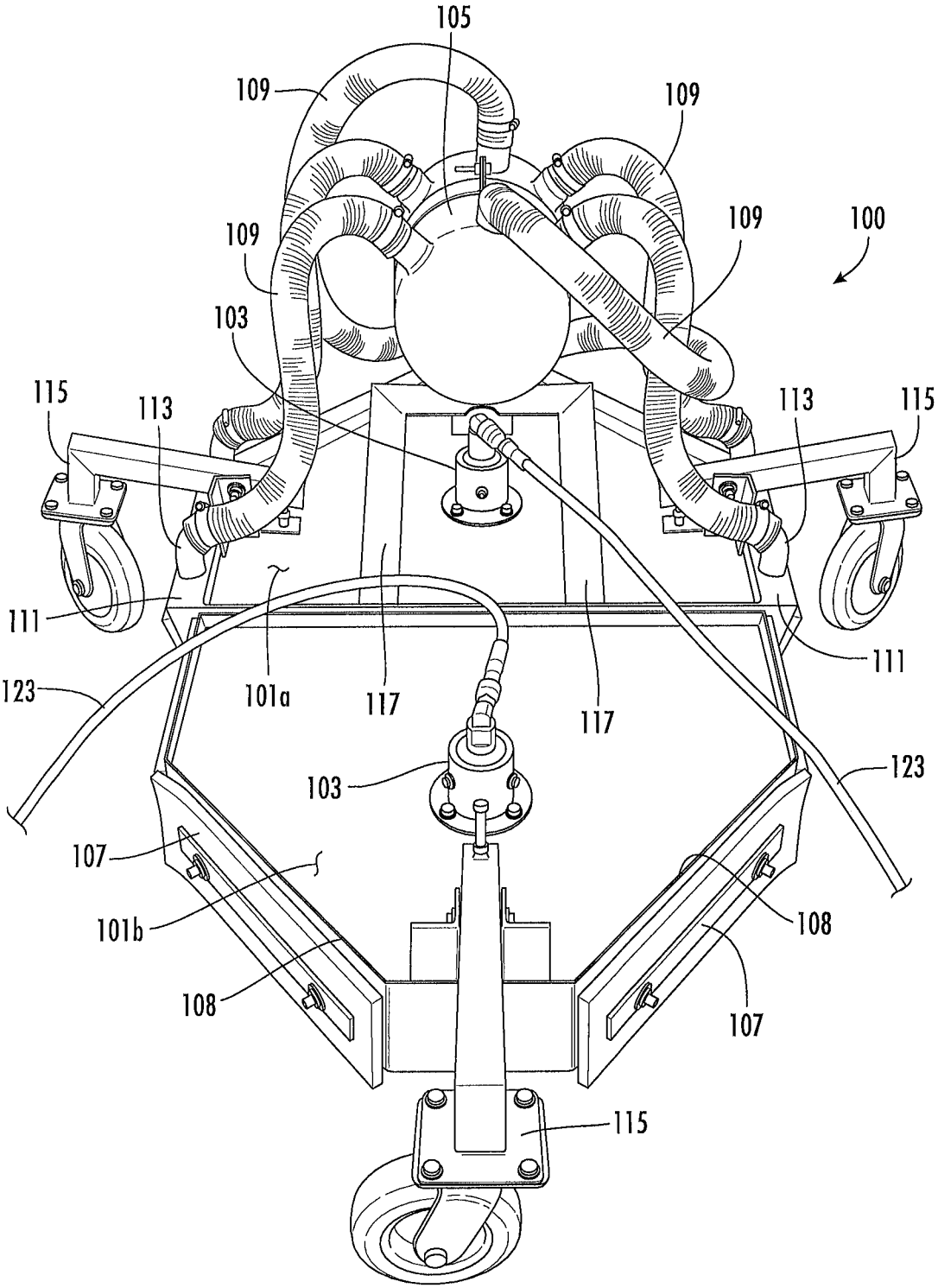
FIG. 1B is a front perspective view of the apparatus of FIG. 1A.
Figure 1C:
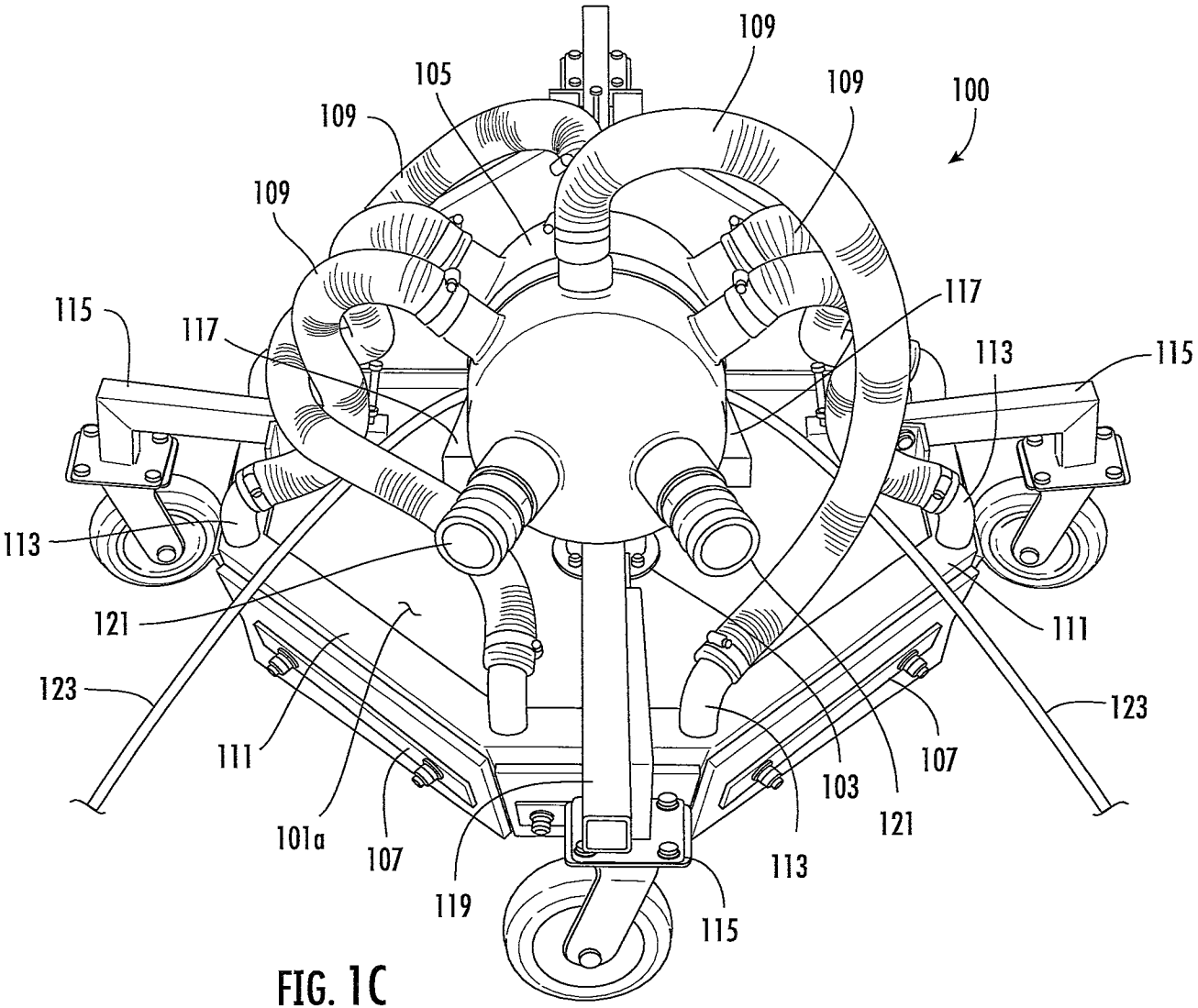
FIG. 1C is a rear perspective view of the apparatus of FIG. 1A.

Referring now to FIGS. 1A-1C in the drawings, an apparatus for rejuvenating lines on roads is illustrated according to a preferred embodiment of the present application. Apparatus 100 is preferably a modular system that includes two individual cleaning units 101*a*/101*b*. Under the preferred embodiment, each cleaning unit 101 is a cleaning hood assembly uniquely configured to clean and therefore rejuvenate lines on roads. While illustrated as two units 101*a*/101*b* being coupled to each other, it should be appreciated that alternative embodiments of the present application may include varying numbers of units, including some units that may vary in shape, size, and configuration. For example, in the preferred embodiment, each unit 101 is shaped with six non-uniform sides and six non-uniform angles; although six-sided, the unit takes on a semi-triangular shape, with one significantly longer side being similar to the base of a triangle. Under the preferred embodiment, the two units 101*a*/101*b* are coupled at each of their respective "triangle base" so as to have to the two units shaped facing opposite directions. Additionally, it should be appreciated that alternative embodiments may have variances in orientation of units, such as being oriented side-to-side or front-to-back.

As noted, the present application may also include alternative embodiments varying in size, shape, and configuration. For example, some units may be round, square, rectangular, triangular, or a variety of other shapes. In some embodiments, there may even be additional stacked units, or units positioned at varying heights. While the apparatus of the present application is uniquely configured for use on roads, it should be understood that alternative embodiments may be adapted for rejuvenating and cleaning other surfaces, such as sidewalks, plazas, or any other large surface area susceptible to sizeable spills and gathering of dirt/debris.

Figure 3:
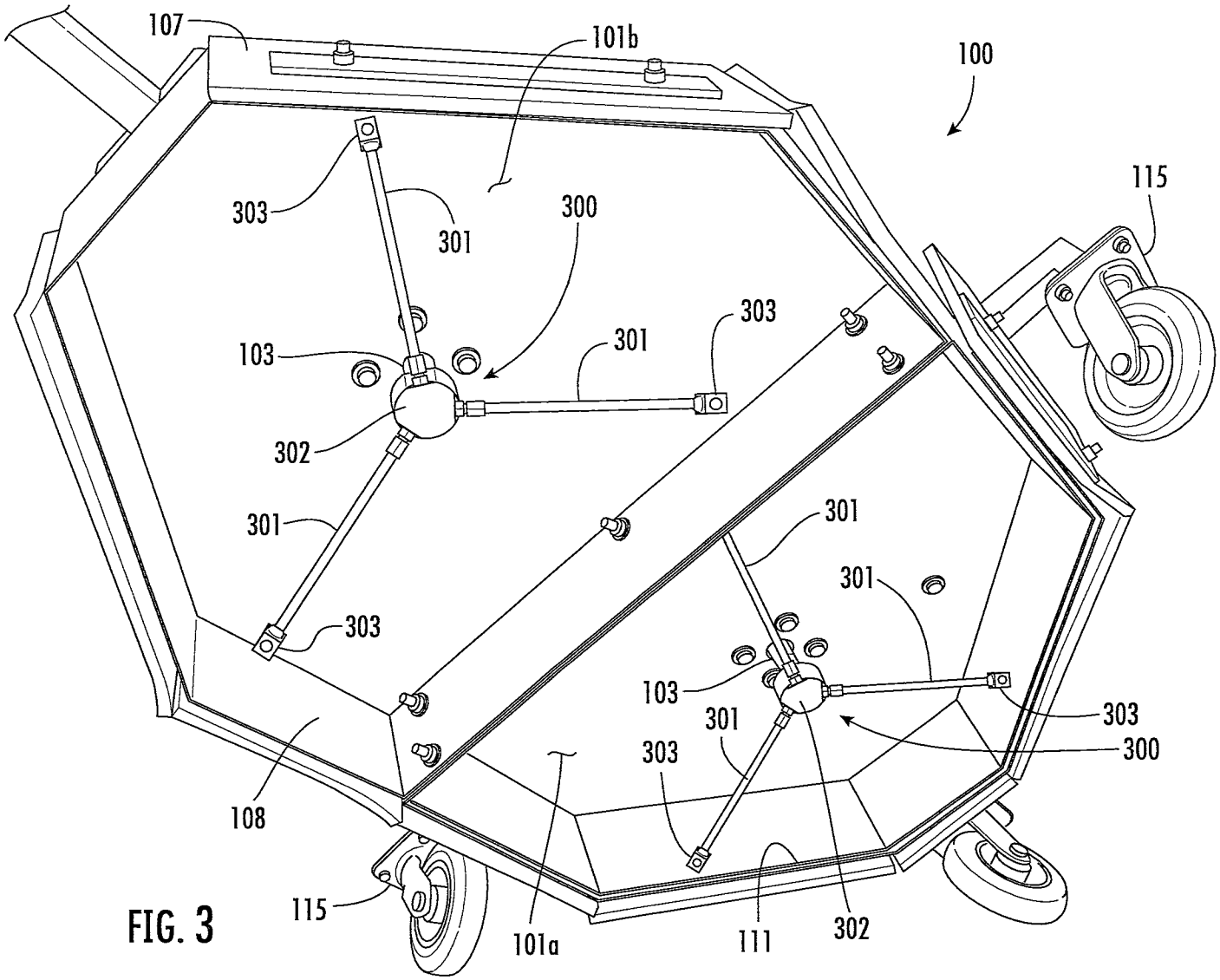
FIG. 3 is a bottom perspective view of an apparatus for rejuvenating lines on roads according to an alternative embodiment of the present application.

Each cleaning unit 101*a*/101*b* is preferably defined around its outer edges by frame 108 and skirts 107. The skirts 107 are coupled to an outer edge surface of the frame 108, such that the frame 108 edges are substantially enclosed by the skirts 107. A view from the underside of the unit, as seen in FIG. 3, best illustrates the spatial relationship between the frame 108 and the skirts 107. The frame 108 is preferably made of a steel material; however, it should be appreciated that alternative embodiments of the present application may include systems made of other materials in whole or in part. For example, in some embodiments, a polymer or rubber material may form a substantial portion of the frame, such that the system weight is reduced. Other embodiments may have frames made of an aluminum or other galvanized metal material. The frame 108 is preferably carried slightly above the ground to reduce wear on the steel frame.

The skirts 107 are preferably made from rubber and are configured such that they have a squeegee effect on liquids and debris while moving along a surface. Although the skirt material is subject to wear while running along the pavement surface, the unique configuration of the skirts 107 and their coupling mechanism to the frame 108 allows for efficient removal of worn skirts and attachment of new skirts. It should be understood that alternative embodiments of the present application may have skirts of varying material, such as polymers, and also that some embodiments may utilize a different series of pieces designed for creating a squeegee effect. In even further embodiments a skirt system may not be necessary.

Each unit 101*a*/101*b* preferably includes a spray connection 103 disposed near a central portion of a top surface of the respective unit. Spray connection 103 is preferably configured to provide a connection point between each unit 101 and a high-pressure water hose 123. Spray connection 103 is configured to direct a high-pressure stream of liquid downward to the underside of the unit 101. The spray connection 103 is further illustrated in FIGS. 6A-6D and described with additional detail below. Under the preferred embodiment, the liquid is water supplied from a water storage tank within an operably associated vehicle, the water hose 123 connecting on one end to the storage tank and on the other end to the spray connection 103. However, in alternative embodiments, there may be various liquids or cleaning substances used, such as any kind of cleaning chemical, pre-treatment, or other similar substance. Further, it should be appreciated that alternative embodiments may have various sources for providing water or other liquids. For example, some systems may be integrated with vehicles that have an internal water tank, while others may be integrated with a water tank that is externally mounted to a vehicle, or even to a standalone water supply.

Some embodiments of the present application may include multiple connection points similar to spray connection 103 on at least one unit 101. For example, in at least one embodiment, there is two spray connection points each connecting an external hose to a cleaning unit; the first connection point is associated with a hose configured for providing a pretreatment liquid substance to the cleaning unit; the second connection point is associated with a hose configured for providing water to the cleaning unit. In operation of such embodiment, the pretreatment substance would first be sprayed onto the surface to be rejuvenated, followed by a spray of water from the second connection point to wash the pretreatment and any dirt or debris from the surface. It should be understood that pretreatment is not always necessary; as such, some embodiments may include the capability of a pretreatment, but do not always utilize such capability.

Collection tank 105 is preferably coupled to unit 101*a* using mounting brackets 117. Some alternative embodiments of the present invention may include various ways to couple the collection tank 105 to the unit 101. Collection tank 105 is preferably configured as a vacuum canister meant to disperse and regulate vacuum flow to all areas of the unit, and where the vacuumed materials collect in transition from the surface to a storage point.

Material, including any of the liquids and waste material from the surface being cleaned, is preferably vacuumed from underneath unit 101*a* through a small area between skirts 107 and frame 108. The small area is defined by angled trim 111, which is preferably shaped as a triangle with two corners at the top and an open point at the bottom. The small opening in the triangle-shaped angled trim 111 is uniquely configured to prevent large debris, such as sizeable rocks and other materials from being vacuumed into the collection tank 105 and any further storage tank. Such rocks and other material are likely to damage, clog, or otherwise negatively affect operation of the system, and therefore preventing intrusion of those materials is vital to efficient operation of the system. Although unit 101*b* is only configured to spray substances on to the surface and not vacuum any material, it should be appreciated that alternative embodiments of the present application may include multiple units with vacuuming capabilities. Additionally, it should be understood that alternative embodiments may not utilize a triangle-shaped trim, but rather could utilize other shapes, even including a straight trim with an opening for material to travel through. Filters, screens, or other mechanisms meant for preventing unwanted material from being vacuumed may be present within the trim in some alternative embodiments.

When material, including water, any pretreatment chemicals, and the dirt/debris being removed from a surface is vacuumed through the opening in angled trim 111, the material travels through hoses 109 and into collection tank 105. As illustrated, there are six hoses 109, each coupled to angled trim 111 at hose connections 113. Hose connections 113 are preferably configured to define an opening and connection point, through which material can flow from the underside of the unit 101, through angled trim 111, and into hose 109. In alternative embodiments, there may be varying numbers of hoses and hose connections, depending on the size and desired performance of the unit.

Collection tank 105 also includes at least one vacuum connection 121. Under the preferred embodiment, and as illustrated, there are two vacuum connections 121 on collection tank 105, disposed on a rear portion of the collection tank 121. By positioning the connections 121 on a rear portion of the tank, vacuum hoses (illustrated in FIGS. 2A and 2B) may be connected to the collection tank without having to cross and potentially tangle with the other hoses of the system. However, in alternative embodiments of the present application, the collection tank may have different numbers of vacuum connections and the connections may be positioned differently than those of the preferred embodiment.

In some alternative embodiments of the present application, there may not be vacuum connections; rather, the spray arms or other rotating system positioned underneath the unit may be configured to rotate at high rates of speed to create a suction effect. Such suction can create a fan forced event in which the water and other materials is suctioned from the surface and driven into a recovery hose, or other storage device.

Apparatus 100 preferably includes a connection point 119 that is configured for attaching a controlling device or maneuvering member. Under the preferred embodiment, connection point 119 extends from mounting bracket 117 in a horizontal direction, such that the connection point 119 can mate with the corresponding mounting member. In the preferred embodiment of the present application, the corresponding mounting member is a vehicle bumper mounting system (illustrated in FIGS. 7A-7C). It should be appreciated that in some alternative embodiments of the present application, a connection point may vary in exact shape and positioning, such that an alternative mounting member or maneuvering member may be utilized with the apparatus. For example, the maneuvering member could be a manually operated handle system, an autonomously operated moving system, or other non-vehicular devices configured for operating the cleaning units.

Apparatus 100 also preferably includes a plurality of wheel assemblies 115. Each wheel assembly 115 (illustrated in additional detail in FIG. 5) preferably includes an angled arm, a mounting bracket, a caster, and a wheel. The mounting bracket couples to a surface of the corresponding unit 101. The angled arm is coupled to the mounting bracket and extends outward from the respective unit 101. The caster, which carries the wheel, is disposed on an end of the angled arm. While the preferred embodiment is illustrated as having four wheel assemblies 115, three being coupled to unit 101*a* and one being coupled to unit 101*b*, it should be appreciated that alternative embodiments of the present application may have varying numbers and positioning of wheels and wheel assemblies.

Under the preferred embodiment, the frontmost wheel assembly is positioned directly in front of the unit 101*b*, such that when the apparatus is being moved forward, the frontmost wheel moves over the centerline of the area to be cleaned/rejuvenated. As the preferred embodiment is configured for rejuvenating lines on roads, the frontmost wheel follows the lines to be rejuvenated; however, with such trajectory, any reflectors or bumps on the road cause the system to be lifted from contacting the surface. In alternative embodiments of the present application, there may not be a centered front wheel; with no front wheel, any bumps such as reflectors will contact the skirt or frame. There may be a type of protective device on the leading edge, such that the skirt or frame is not damaged by any such bumps. It should further be appreciated that alternative embodiments may utilize wheel assemblies that are variable in height, whether the height change be completed manually or automatically.

Figure 2A:
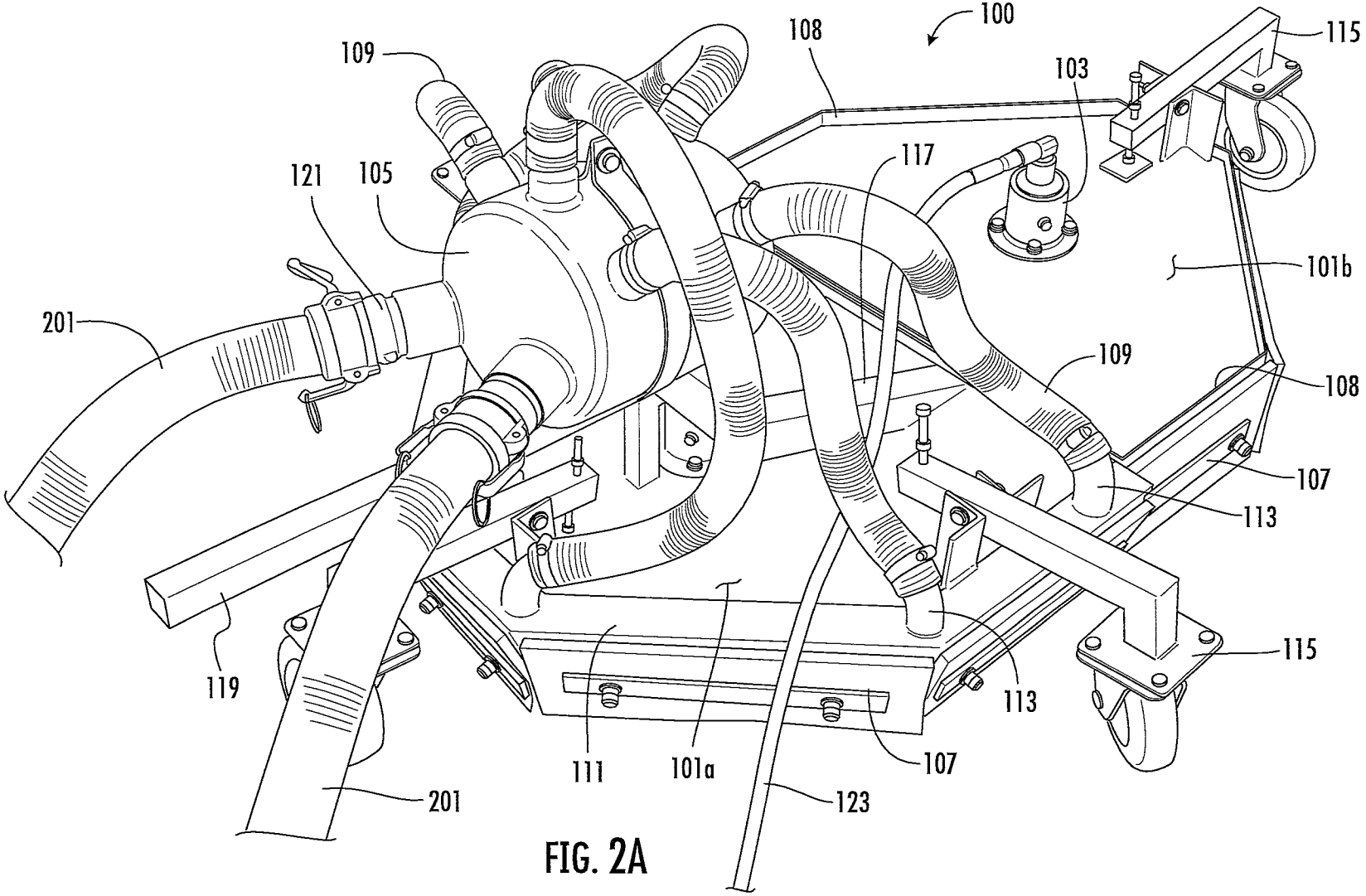
FIG. 2A is a perspective view of the apparatus of FIG. 1A including additional elements.
Figure 2B:
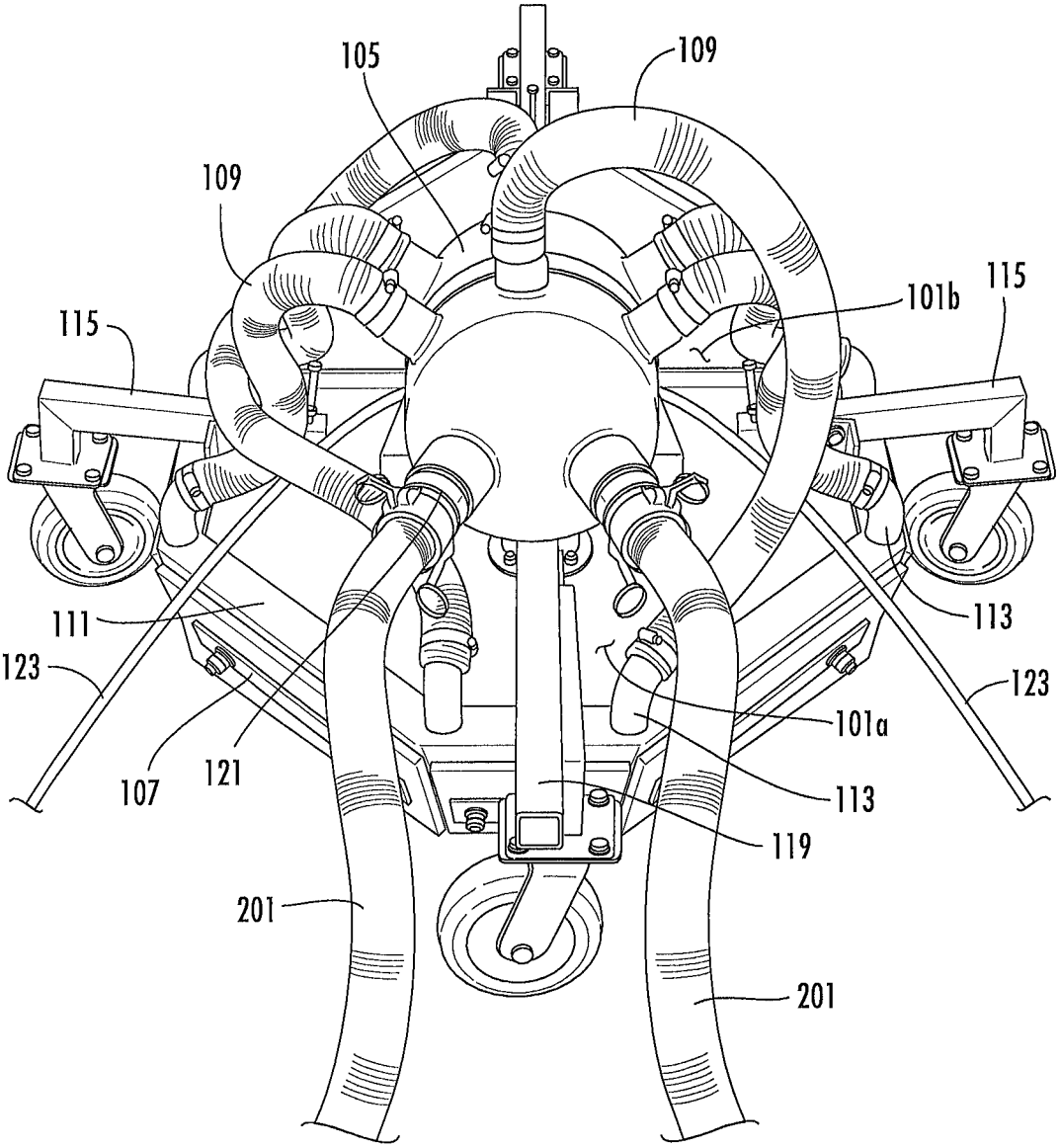
FIG. 2B is a rear perspective view of the apparatus of FIG. 2A.

Referring now also to FIGS. 2A and 2B in the drawings, the apparatus for rejuvenating lines on roads is illustrated according to a preferred embodiment of the present application. FIGS. 2A and 2B both represent a preferred embodiment of the present application, similar to FIGS. 1A-1C; however, in FIGS. 2A and 2B two vacuum hoses 201 are coupled to the collection tank 105 at vacuum connections 121. Although illustrated with two vacuum hoses 201, it should be appreciated that alternative embodiments of the present application may include various numbers of vacuum hoses, directly corresponding with the number of vacuum connections on the collection tank.

While one end of each vacuum hose 201 connects to the collection tank 105 at vacuum connections 121, the opposing end of each vacuum hose 201 is preferably connected to an external connection point. The external connection point may be on various pieces of equipment; however, under the preferred embodiment the external connection point is on a vehicle carrying suction, filtration, and storage equipment (illustrated in FIGS. 7A-10).

Referring now also to FIG. 3 in the drawings, the underside of the apparatus for rejuvenating lines on roads is illustrated according to an alternative embodiment of the present application. As noted above, the spatial relationship between skirts 107, frame 108, and angled trim 111 may provide distinct advantages for suctioning material off of the surface. Unit 101*a*, which is the rear unit under the preferred embodiment, is preferably configured for suctioning material from the surface being rejuvenated. FIG. 3 best illustrates the small opening in the underside of angled trim 111 where the material is to be vacuumed through. Although some small rocks and sediment may be vacuumed through angled trim 111, it should be understood that the unique configuration minimizes the size of debris passed through, and therefore minimizes and backups or clogging downstream in the vacuum system.

Another notable piece now seen in FIG. 3 is the underside of spray connection 103, disposed on a bottom surface of both units 101*a/b*. A pair of wand attachments 300 are coupled to the bottom of spray connections 103, each having a wand base 302, arms 301, and wand tip 303. Under the preferred embodiment of the present application, each wand attachment 300 includes three arms 301. However, it should be understood that in some alternative embodiments, there may be various numbers of arms. The wand attachments are further described below when also referencing FIGS. 4A and 4B.

Figure 4A:
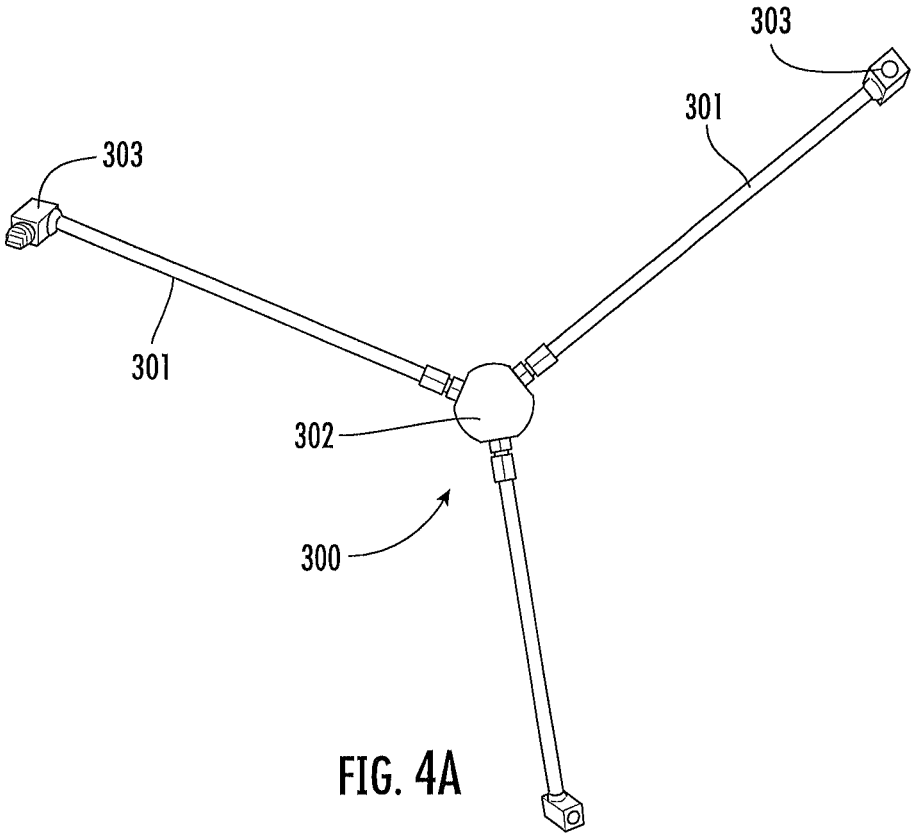
FIG. 4A is a perspective view of a wand attachment associated with the apparatus for rejuvenating lines on roads according to a preferred embodiment of the present application.
Figure 4B:
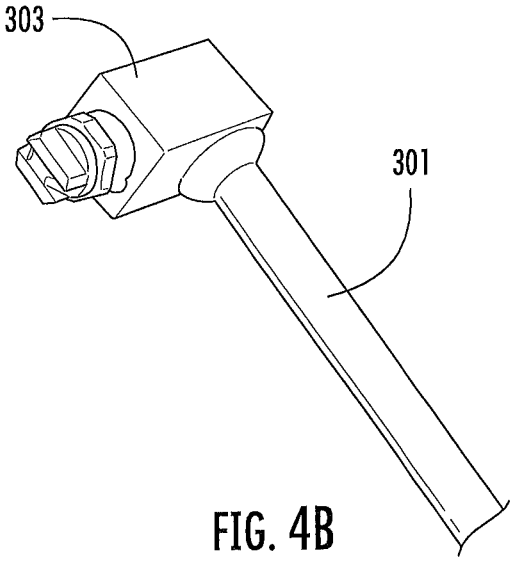
FIG. 4B is a perspective view of a wand tip of the wand attachment of FIG. 4A.

Referring now also to FIGS. 4A and 4B in the drawings, a wand attachment for use with the apparatus for rejuvenating lines on roads is illustrated according to a preferred embodiment of the present application. As described above, wand attachment 300 preferably includes a wand base 302, three wand arms 301 extending outward from wand base 302, and a wand tip 303 disposed at the end of each wand arm 301. The wand base 302 preferably screws onto a bottom portion of a bearing or swivel within the spray connection 103 (Bearings described below). It should be appreciated that some embodiments may have a singular piece where the arms and base are one with each other, or even that the arms directly attach without a true base portion. Although the preferred embodiment utilizes a simple threaded portion to screw the wand base or spray arms on, it should be appreciated that alternative embodiments may utilize various coupling methods or even the wand or swivel being a single piece with a rotatable bearing. Some embodiments may have multiple pieces with a similar rotatable bearing. For example, in some embodiments, a set screw may be utilized to secure the wand attachment to spray connection 103.

In operation of the preferred embodiment, water flows through hose 123 and into spray connection 103. Within spray connection 103, a high-pressure beam of water travels through a center opening of the bearing or swivel and into the wand attachment 300. Within wand attachment 300, the water then disperses into each wand arm 301 or spray arm, still maintaining a single high-pressure beam within each respective arm. When the beam reaches the end of wand arm 301 and travels into wand tip 303, the high-pressure beam is then expelled though a single aperture in wand tip 303. Under the preferred embodiment, the wand tip is angled at a selected degree relative to the arm, such that when water is expelled through the aperture, rotation of the entire wand attachment 300 is generated.

It should be understood that in alternative embodiments of the present application, the angles of the wand tip may vary to create different desired rotation directions and speeds. For example, some embodiments may have the wand tips of the wand attachment for unit 101*a* set to cause opposite rotation to the wand attachment of unit 101*b*, such that the two have units have counter-rotating wand attachments. It should also be appreciated that some embodiments may have varying wand attachments, such as one with wand arms including a plurality of downward facing apertures, such that some water or other liquid is released between wand base and the wand tip.

Figure 5:
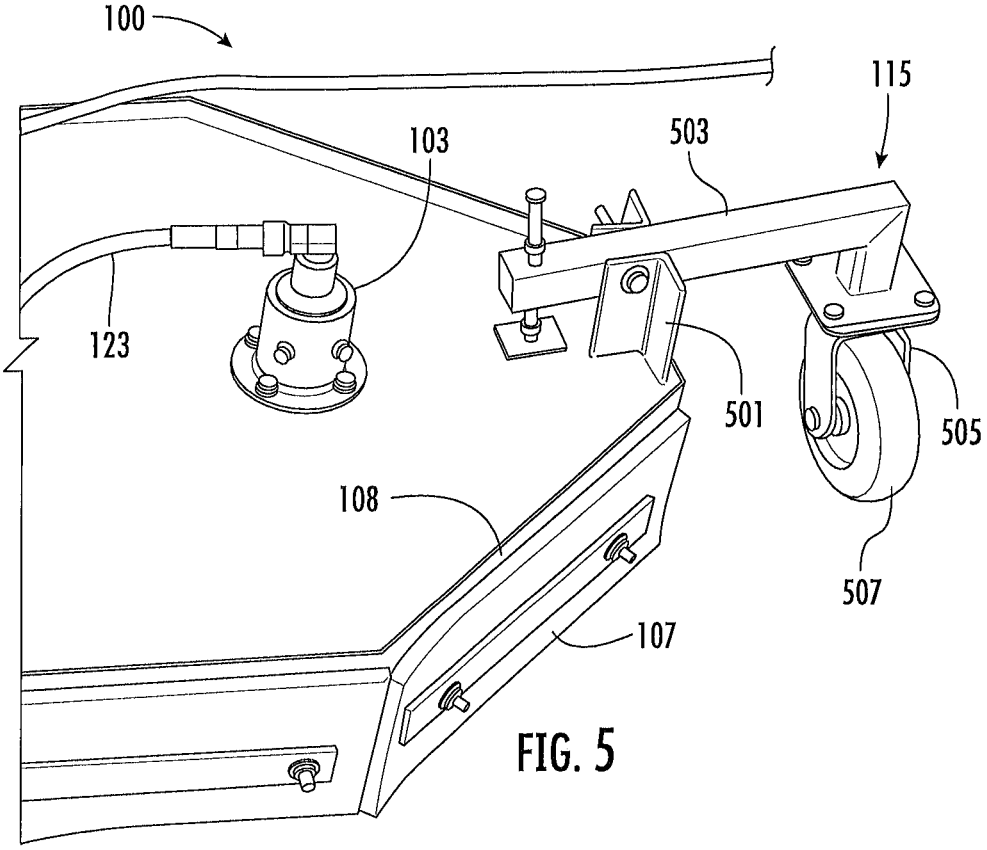
FIG. 5 is a partial perspective view of the apparatus of FIG. 1A.
Figure 6A:
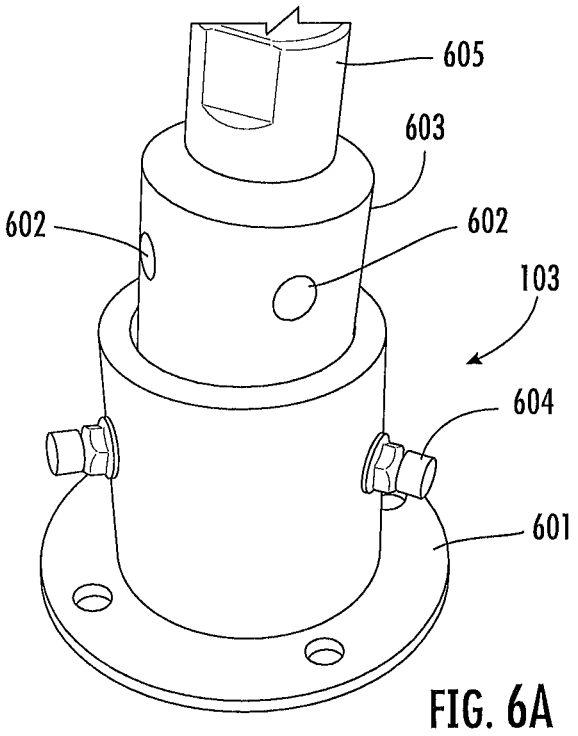
FIG. 6A is a perspective view of a connector and housing element for use with the apparatus for rejuvenating lines on roads according to a preferred embodiment of the present application.
Figure 6B:
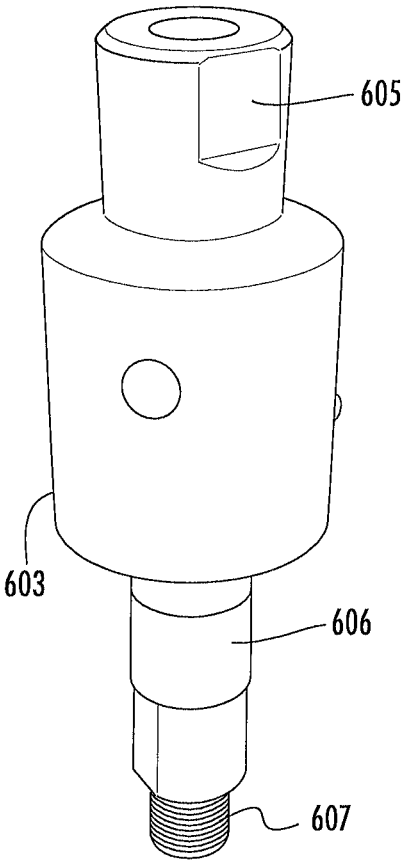
FIG. 6B is a perspective view of the connector of FIG. 6A.
Figure 6C:
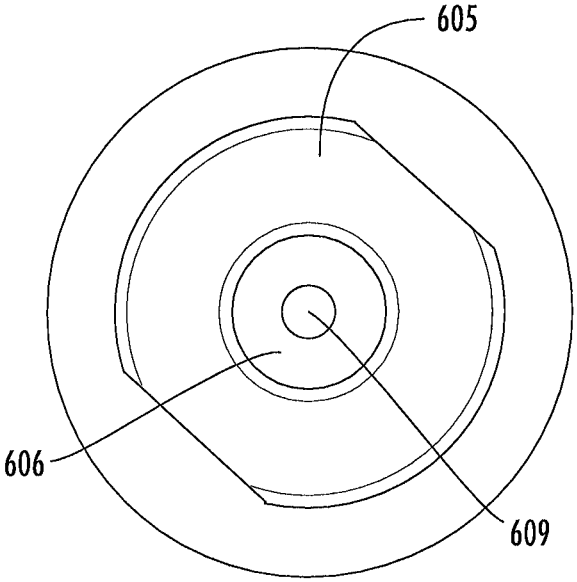
FIG. 6C is a top end view of the connector of FIG. 6A.
Figure 6D:
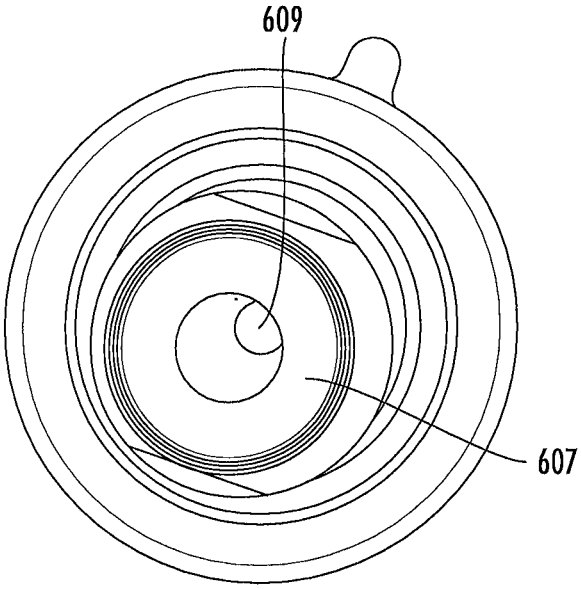
FIG. 6D is a bottom end view of the connector of FIG. 6A.

Referring now also to FIG. 5 in the drawings, a zoomed in view of the apparatus for rejuvenating lines on roads is illustrated according to the preferred embodiment of the present application with a focus on the spray connection and wheel assembly. As described above, each wheel assembly 115 preferably includes an angled arm 503, a mounting bracket 501, a caster 505, and a wheel 507. The mounting bracket 501 couples to a surface of the corresponding unit 101. The angled arm 503 is coupled to the mounting bracket 501 and extends outward from the respective unit 101. The caster 505, which carries the wheel 507, is disposed on an end of the angled arm 503.

The tires on the wheel of each wheel assembly are preferably a substantially solid material with a slight amount of air in them, allowing for substantial durability while minimizing maintenance. However, in alternative embodiments of the present application, the tires may be made of alternative materials. For example, some embodiments may include tires that are foam filled, tires that are solely filled with air, or tires that are of a solid material.

In FIG. 5, spray connection 103 is illustrated in a position secured to unit 101*b*, with water hose 123 attached to a top portion of the connection. The individual components and details of the spray connection are best described below and illustrated in FIGS. 6A-6D.

Referring now also to FIGS. 6A-6D in the drawings, the spray connection 103 for the apparatus 100 for rejuvenating lines on roads is illustrated according to a preferred embodiment of the present application. Spray connection 103 is uniquely configured to provide a high-pressure stream of water from water hose 123 to the wand attachment 300 on the underside of unit 101.

Spray connection 103 preferably includes a mounting base 601, a central bearing 603, a spray connection head 605, and a shaft 606. Spray connection head 605 is disposed at a top portion of the central bearing 603 and is configured for coupling and operability with water hose 123. Central bearing 603 preferably includes apertures 602 on the side surface for securement within mounting base 601 using fasteners 604. It should be understood that a variety of fastener/aperture systems may be used within alternative embodiments of the present application, including the possibility that the central bearing is a single unit with the mounting base, such that no fastening is necessary. Positioned within the connection head 605 and central bearing 603 is shaft 606, which is configured to be rotatable within the system for purposes of facilitating wand attachment motion. Under the preferred embodiment, wand attachment 300 is coupled to a threaded portion 607 of shaft 606, such that when wand attachment 300 motion is generated, the shaft 606 rotates within the spray connection. The shaft 606 includes a center aperture 609 configured to serve as a pathway for the high-pressure beam of water traveling through the system. Although it is preferred to use the wand system described herein, it should be appreciated that alternative embodiments may use a different water distribution mechanism capable of propelling water to the underside of the unit. For example, in at least one embodiment, a central distribution node may be present that propels high-pressure spray of water from a single central location to the surrounding 360 degrees, reaching all outer edges of the bottom of the system.

The main purpose of the bearings is for efficient, high-speed rotation of the wand attachment, or any other relevant water distribution mechanism configured to create an agitation. It should be understood that various types of bearings will work with any embodiment of the present invention, so long as rotatable motion is present. For example, any type of swivel bearing may be used, including hydraulically spun bearings. In embodiments with hydraulically spun bearings, it may not be necessary for the angled wand tip to aid in wand motion generation. It should be understood that some alternative embodiments of the present application may utilize other agitation inducing elements underneath the unit in a rejuvenating process. For example, in place of rotating wands expelling water, a rotary or other drum system may be used to agitate the surface to rejuvenate the markings. Other embodiments may include stationary elements, such as a wand or other shaped device, the maintains a consistent downward spray without use of rotation.

Figure 7A:
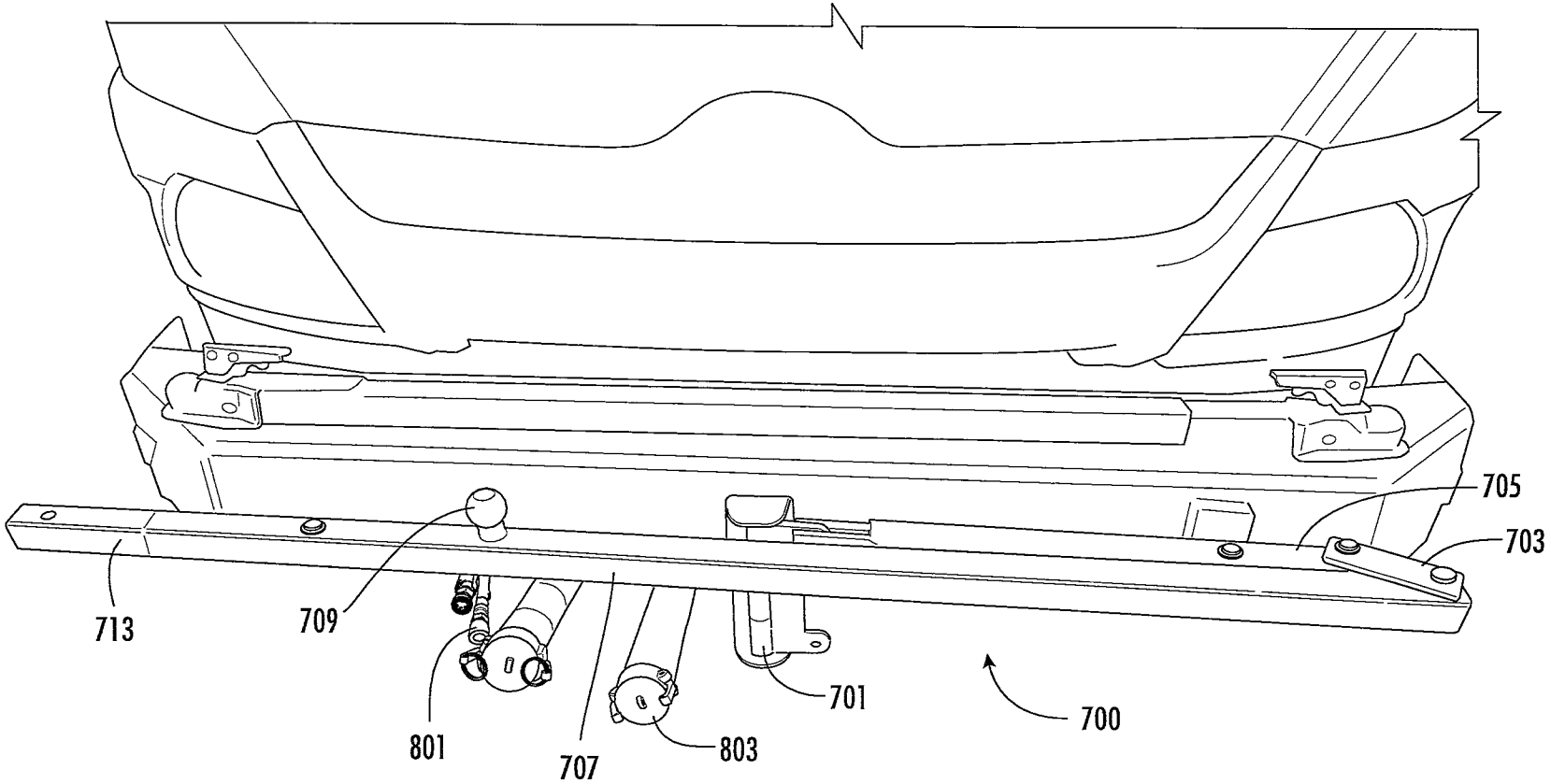
FIG. 7A is a perspective view of a vehicle attachment mechanism configured for compatibility with an apparatus for rejuvenating lines on roads according to a preferred embodiment of the present application.
Figure 7B:
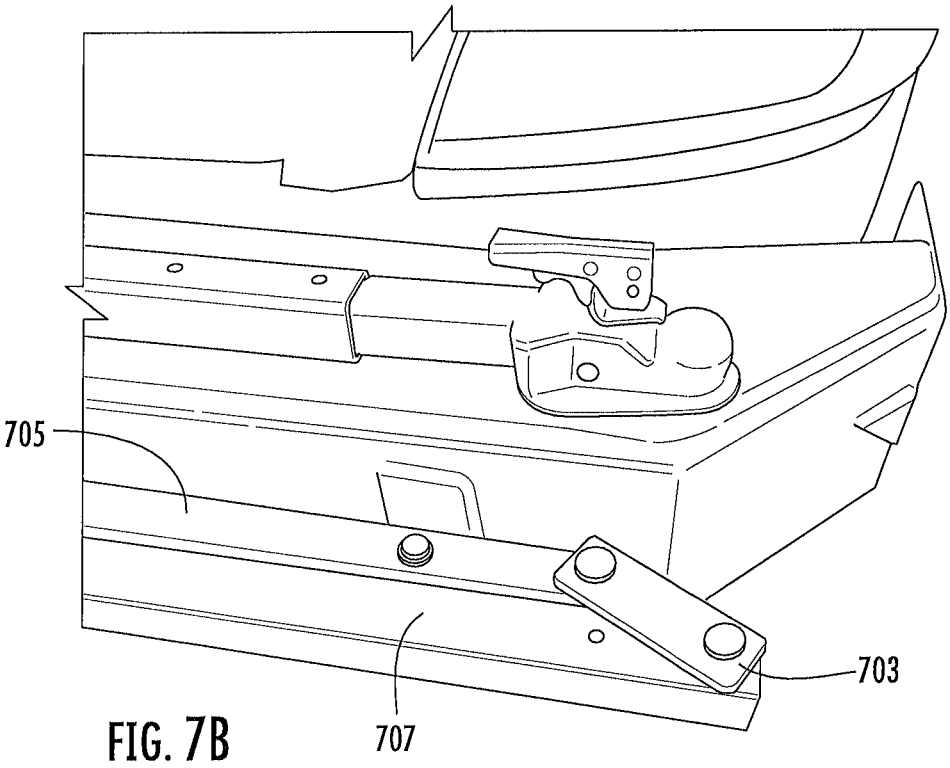
FIG. 7B is a partial perspective view of the vehicle attachment mechanism of FIG. 7A.
Figure 7C:
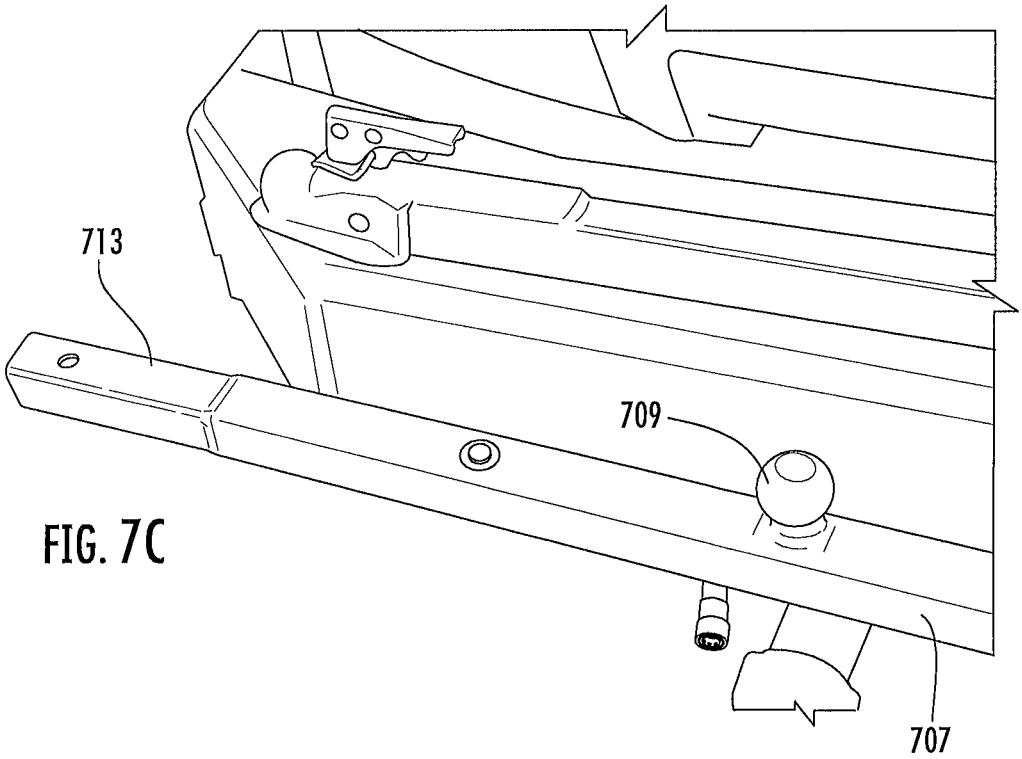
FIG. 7C is a partial perspective view of the vehicle attachment mechanism of FIG. 7A.

Referring now also to FIGS. 7A-7C in the drawings, a vehicle bumper attachment system for use with the apparatus for rejuvenating lines on roads is illustrated according to an embodiment of the present application. Vehicle attachment mechanism 700 is preferably configured for attachment to the front bumper of a large vehicle capable of manipulating apparatus 100. Vehicle attachment mechanism preferably includes a central base member 701, a first arm segment 705, a second arm segment 707, the first and second arm segments 705/707 being joined at a hinged point 703. Under the preferred embodiment, first arm segment 705 is shorter in length than second arm segment 707. As illustrated in FIGS. 7A-7C, the mechanism 700 is in a stowed position without apparatus 100 attached to it. In an operation position, when the apparatus 100 is to be attached and used, the arms are extended away from the vehicle bumper.

Second arm segment 707 preferably includes an attachment end 713 on the end most distant from the vehicle bumper in the operation position. Segment 707 also preferably includes a ball attachment member 709. In operation, an apparatus 100 is coupled to attachment end 713 using connection point 119, where the apparatus is then pushed or otherwise manipulated in front of the vehicle, either at a center point, or at the driver or passenger side of the vehicle.

Although the preferred embodiment of the present application is described and illustrated as having a vehicle attachment mechanism with a pair of arms configured for extending away to one portion in front of the vehicle, it should be appreciated that alternative embodiments may include additional arms, or even additional connection points, such that an apparatus may be pushed in any area in front or to the side of the vehicle; in even further embodiments, it may be possible to attach and carry multiple apparatuses using the same attachment mechanism. Whether carried by one attachment mechanism, or multiple attachment mechanisms, some alternative embodiments of the present application may be configured in ways to clean or rejuvenate multiple areas at one time; for example, a system may include a cleaning apparatus on both a driver side and passenger side of the vehicle, such that the vehicle may drive down the center of a lane and rejuvenate marking on both sides of the lane at one time.

Figure 8A:
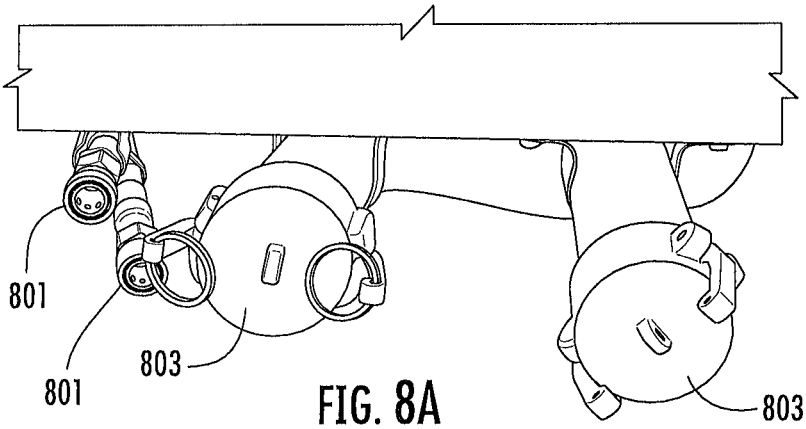
FIG. 8A is a perspective view of a vehicle connection point configured for compatibility with an apparatus for rejuvenating lines on roads according to a preferred embodiment of the present application.
Figure 8B:
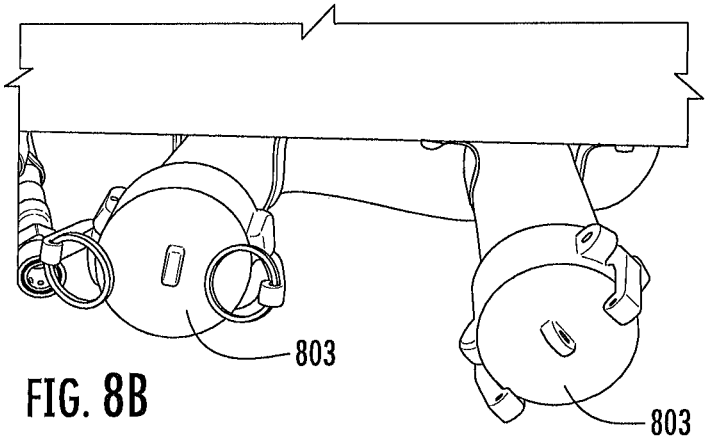
FIG. 8B is a perspective view of a hose connection of the vehicle connection point of FIG. 8A.
Figure 8C:
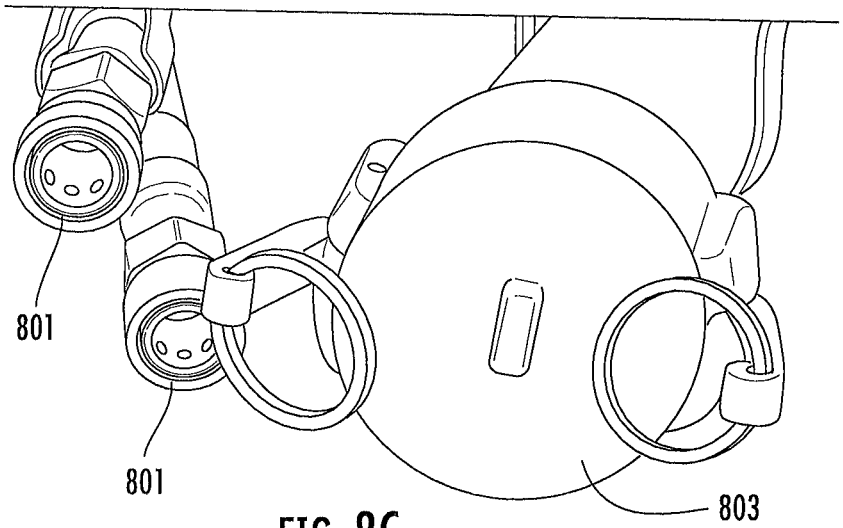
FIG. 8C is a perspective view of an additional hose connection of the vehicle connection point of FIG. 8A.

Referring now also to FIGS. 8A-8C in the drawings, a set of vehicle hose connection points for use with the apparatus for rejuvenating lines on roads is illustrated according to an embodiment of the present application. Hose connection points 801 and 803 are preferably configured for compatibility with the hoses of apparatus 100. As shown in FIGS. 8A-8C, there are two hose connection points 801 sized for operable association with water hose 123, one for each water hose 123 extending to each respective unit 101*a/b*. There are also two hose connection points 803 sized for operable association with vacuum hoses 201. It is preferred that each hose connection point 801/803 is associated with a compatible system within the vehicle. For example, hose connection point 801 preferably connects to a water tank within the vehicle that is capable of providing enough water for operation of the apparatus 100; hose connection point 803 is preferably connected to a vacuum system within the vehicle that is capable of vacuuming and storing the material that is collected from the surface through collection tank 105.

Figure 9:
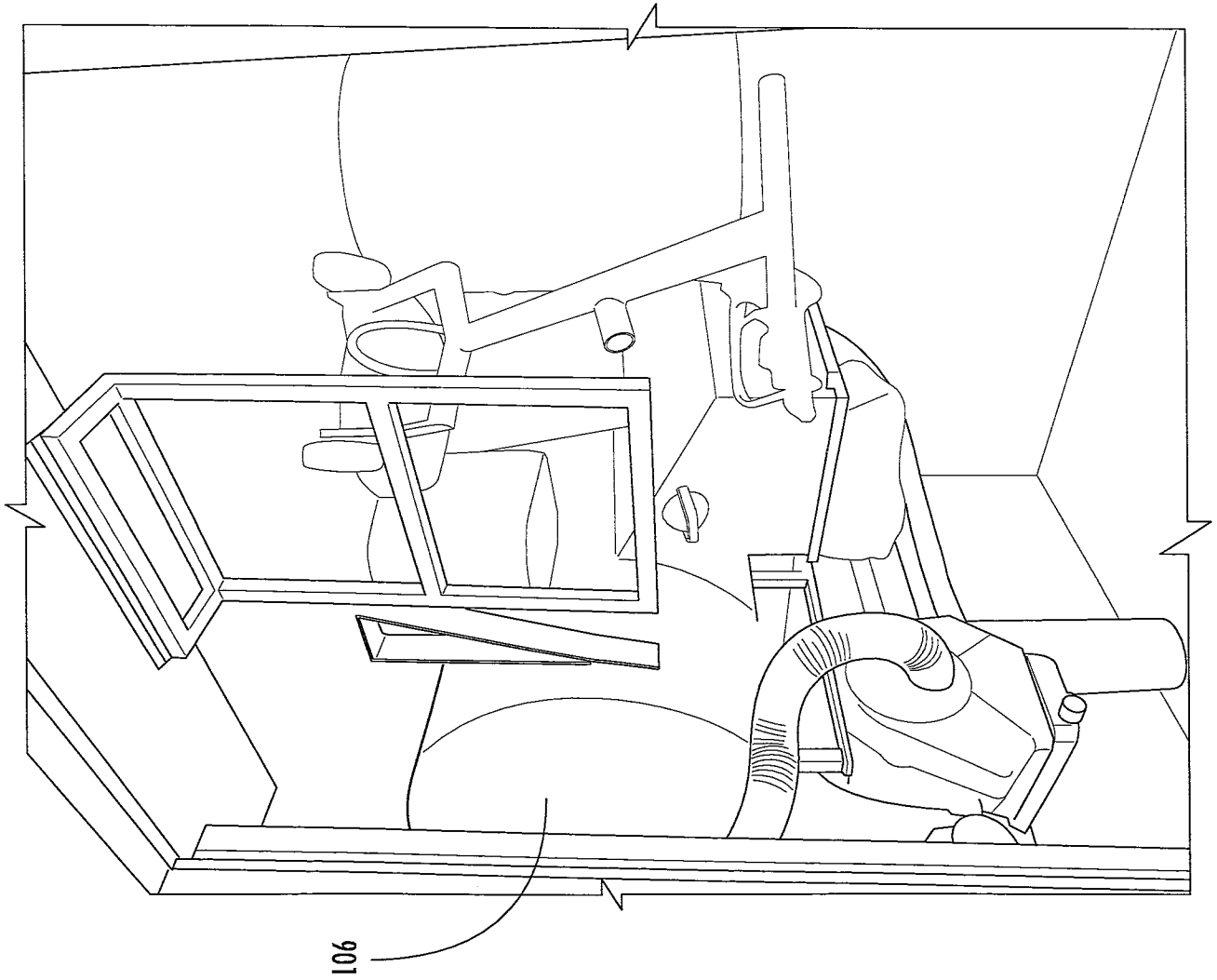
FIG. 9 is a perspective view of the interior of a vehicle including a tank for containing liquid configured for compatibility with an apparatus for rejuvenating lines on roads according to a preferred embodiment of the present application.
Figure 10:
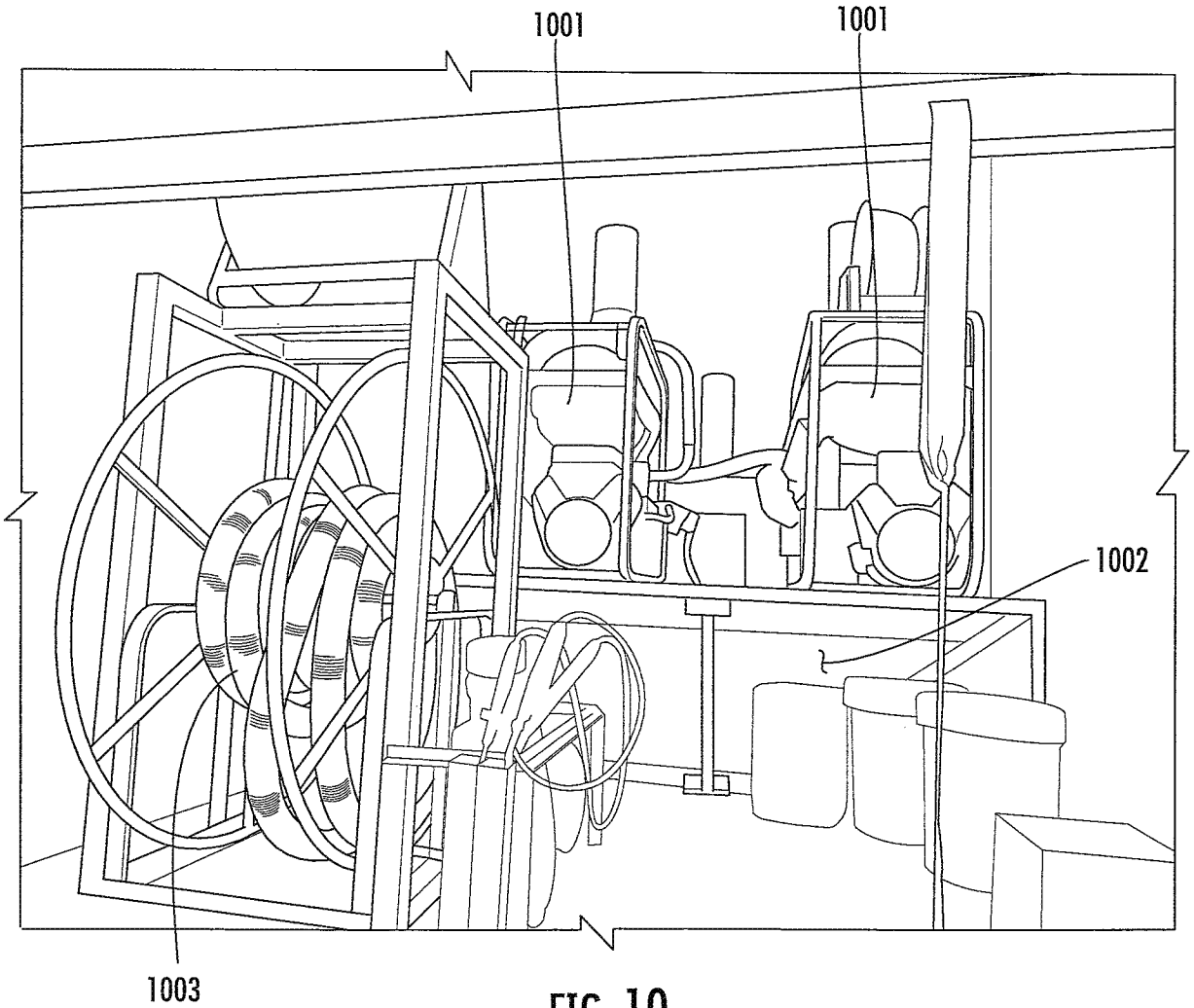
FIG. 10 is an additional perspective view of the interior of the vehicle of FIG. 9, including motors configured for compatibility with an apparatus for rejuvenating lines on roads according to a preferred embodiment of the present application.

Referring now also to FIGS. 9 and 10 in the drawings, the internal equipment of a vehicle for use with the apparatus for rejuvenating lines on roads is illustrated according to an embodiment of the present application. FIG. 9 best illustrates a view from a side door of the vehicle, wherein a tank 901 is seen. Tank 901 is preferably configured to store the water, or any other liquid, that may be used in operation of apparatus 100. FIG. 10 best illustrates a view from the rear door of the vehicle, wherein motors 1001, a storage tank 1002, and additional hoses 1003 are seen. Motors 1001 are preferably configured to power all operation of the apparatus 100, including any heating and pressurization of the water, and operation of the vacuum system. The additional hoses 1003 are not required, and are configured for additional vacuum capabilities of the present system. Although the vehicle is illustrated with the layout of the tanks and motors as such, it should be appreciated that alternative embodiments of the present application may utilize various truck cargo layouts, including the possibility that varying embodiments may utilize different numbers and positioning of both tanks and motors.

Although not illustrated herein, it should be understood that additional efficiency-related systems may be included in alternative embodiments. For example, an embodiment may include a lifting mechanism capable of loading the apparatus into the vehicle when outside of operation. Such lifting mechanism could be any design such as a winch, hydraulic system, or other mechanism. Such lifting systems may also be present on the front of a vehicle, whether it be hydraulically, electrically, mechanically, or pneumatically operated. The front lifting mechanism may be utilized to carry the apparatus on the front portion of the vehicle above the surface when not in use, and then lowered onto the surface when desired.

It is apparent that a system with significant advantages has been described and illustrated. The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

I claim:

1. An apparatus for rejuvenating markings on roads, comprising:

at least one cleaning unit, comprising:

a frame;

at least one skirt member coupled to an external surface of the frame;

at least one spray connection disposed at least partially on a top surface of the frame, the spray connection being configured to project a substance downward; and at least one wand member coupled to an underside of the at least one spray connection;

a collection tank coupled to the cleaning unit, the collection tank comprising:

a plurality of entry points, each configured to mate with a hose; and at least one vacuum connection;

a vacuum member operably associated with the collection tank, the vacuum member being configured, such that material from underneath the associated cleaning unit is suctioned into the collection tank and then from the collection tank into a storage tank; and a connection point configured for attachment to a maneuvering member.

2. The apparatus according to claim 1, wherein the at least one skirt member is configured to create a squeegee effect along the surface being rejuvenated.

3. The apparatus according to claim 1, wherein the at least one frame further comprises:

at least one trim piece.

4. The apparatus according to claim 3, wherein the at least one trim piece is angled, such that the at least one trim piece is substantially triangular, with a small opening at a bottom portion and a wider base area at a top portion.

5. The apparatus according to claim 3, wherein the at least one trim piece comprises:

a plurality of hose connections configured to provide a coupling point for each hose that mates with the plurality of entry points, such that multiple paths are created between the underside of the at least one trim piece and the collection tank.

6. The apparatus according to claim 1, further comprising:

a mounting member coupled to the frame of one of the at least one cleaning units, the mounting member being configured to carry the collection tank.

7. The apparatus according to claim 6, wherein the connection point is disposed on the mounting member.

8. The apparatus according to claim 1, wherein multiple wand members of the at least one cleaning unit rotate in the same direction.

9. The apparatus according to claim 1, wherein multiple wand members of the at least one cleaning unit counter rotate relative to each other.

10. The apparatus according to claim 1, wherein the wand member comprises:

an angled wand tip;

wherein the angle of the wand tip is configured such that a high-pressure stream of water being expelled from the wand tip causes wand member rotation.

11. The apparatus according to claim 1, further comprising:

a plurality of wheel assemblies configured for aiding movement of the apparatus.

12. The apparatus according to claim 1, wherein the maneuvering member is a vehicle.

13. The apparatus according to claim 1, wherein the maneuvering member is manually operated.

14. The apparatus according to claim 1, wherein the maneuvering member comprises:

a plurality of hose connection points;

wherein at least two of the hose connection points are operably associated with a water hose; and wherein at least two of the hose connection points are operably associated with a vacuum hose.

15. The apparatus according to claim 1, wherein the at least one spray connection comprises:

a mounting base;

a central bearing held by the mounting base; and a rotatable shaft within the central bearing;

wherein the rotatable shaft is configured to allow liquid to pass through the spray connection.

16. The apparatus according to claim 15, wherein the rotatable shaft has a threaded portion; and wherein the threaded portion is configured for coupling the wand member to the spray connection.

17. The apparatus according to claim 1, wherein the maneuvering member holds a water storage tank configured for recycling of water used by the apparatus.

* * * * *